US005520018A

United States Patent [19]

Wood

[11] Patent Number: 5,520,018

[45] **Date of Patent: *May 28, 1996**

[54] MACHINE FOR KNITTING A REINFORCEMENT PATTERN OF YARN ON A HOSE

[75] Inventor: Douglas B. Wood, Lincoln, Nebr.

[73] Assignee: The Goodyear Tire & Rubber Company, Akron, Ohio

[ * ] Notice: The term of this patent shall not extend beyond the expiration date of Pat. No. 5,309,738.

[21] Appl. No.: 386,580

[22] Filed: Feb. 10, 1995

[51] Int. Cl.[6] ..... D04B 15/48; D04B 1/22

[52] U.S. Cl. ..... 66/9 A; 66/132 T; 242/47.13; 156/393

[58] Field of Search ..... 66/125 R, 132 R, 66/132 T, 9 A, 9 R, 8; 242/47.01, 47.13; 264/103, 167; 28/101, 102, 175; 156/393

[56] References Cited

U.S. PATENT DOCUMENTS 5,309,738 5/1994 Morris ..... 66/9 A X

*Primary Examiner*—John J. Calvert

*Attorney, Agent, or Firm*—T. P. Lewandowski; H. E. Hummer

[57] ABSTRACT

A knitting machine is described for knitting rows of yarn loops in a helical pattern around the inner core of a hose. The machine comprises at least two concentrically disposed tubes. The first tube rotates concentrically around a straight axis along which the inner core of a hose moves towards an opening in a knitting head. The first tube carries a plurality of needles and needle guides which are equally spaced from, and around, the opening in the knitting head. The second tube concentrically rotates independently around the first tube and carries, i) at least one yarn deck, ii) cams which reciprocate the needles when the first and second tube differentially rotate, and iii) the knitting head. A stationary third, rigid, hollow inner tube can be concentrically disposed within the first tube to guide the inner core to the knitting head.

16 Claims, 2 Drawing Sheets

MACHINE FOR KNITTING A REINFORCEMENT PATTERN OF YARN ON A HOSE

The invention relates to fabric reinforced polymeric or elastomeric hoses. More particularly, the invention relates to a machine for knitting a pattern of yarn around the hollow, cylindrical inner core of a hose, as the hose moves along a straight pathway. Such a machine is at least partially disclosed in U.S. Pat. No. 5,309,738 which is incorporated herein.

There are knitting machines on the market for spirally wrapping one or more strands of yarn around the outer cylindrical surface of a moving core of a hose. There are also knitting machines which are designed to knit rows of loops or wales of yarn longitudinally of a moving core.

The invention, as expressed in the aforementioned patent, is in a machine which is capable of knitting rows of loops or wales of yarn in a helical pattern around the outer cylindrical surface of the inner core of a hose as the core moves in a straight pathway through a knitting head. Such machine also has the advantage of being able to knit the conventional patterns indicated above. The helical pattern knitted by this improved machine produces a reinforcement which resists kinking of the finished hose.

Briefly stated, the machine comprises three concentrically disposed tubular structures. The innermost hollow tube is stationary and acts to guide the inner core of the hose in a straight pathway to the knitting head, the core being concentrically disposed within the innermost tube, as it moves towards the knitting head. The outermost hollow tube is rotatable about the axis of the innermost tube and carries the knitting head, packages or spools of yarn, yarn feeding devices, and cams which control the reciprocation of the knitting needles used in the knitting process. The middle hollow tube, unlike the stationary middle tubes of existing machines, is rotatable about the axis of the innermost tube and carries the knitting needles and their guides. Any suitable means are provided for moving the inner core of the hose along the straight pathway to and from the knitting head. It can be appreciated that the aforementioned helical angle of the knitted yarn loops can be varied by changing the rotational speeds of the middle and outer tubes relative to the speed at which the inner core of the hose travels along the straight pathway.

The following description of the invention will be in relation to an inner core of unvulcanized rubber, and will be better understood by having reference to the accompanying drawing, wherein.

Figure 1:
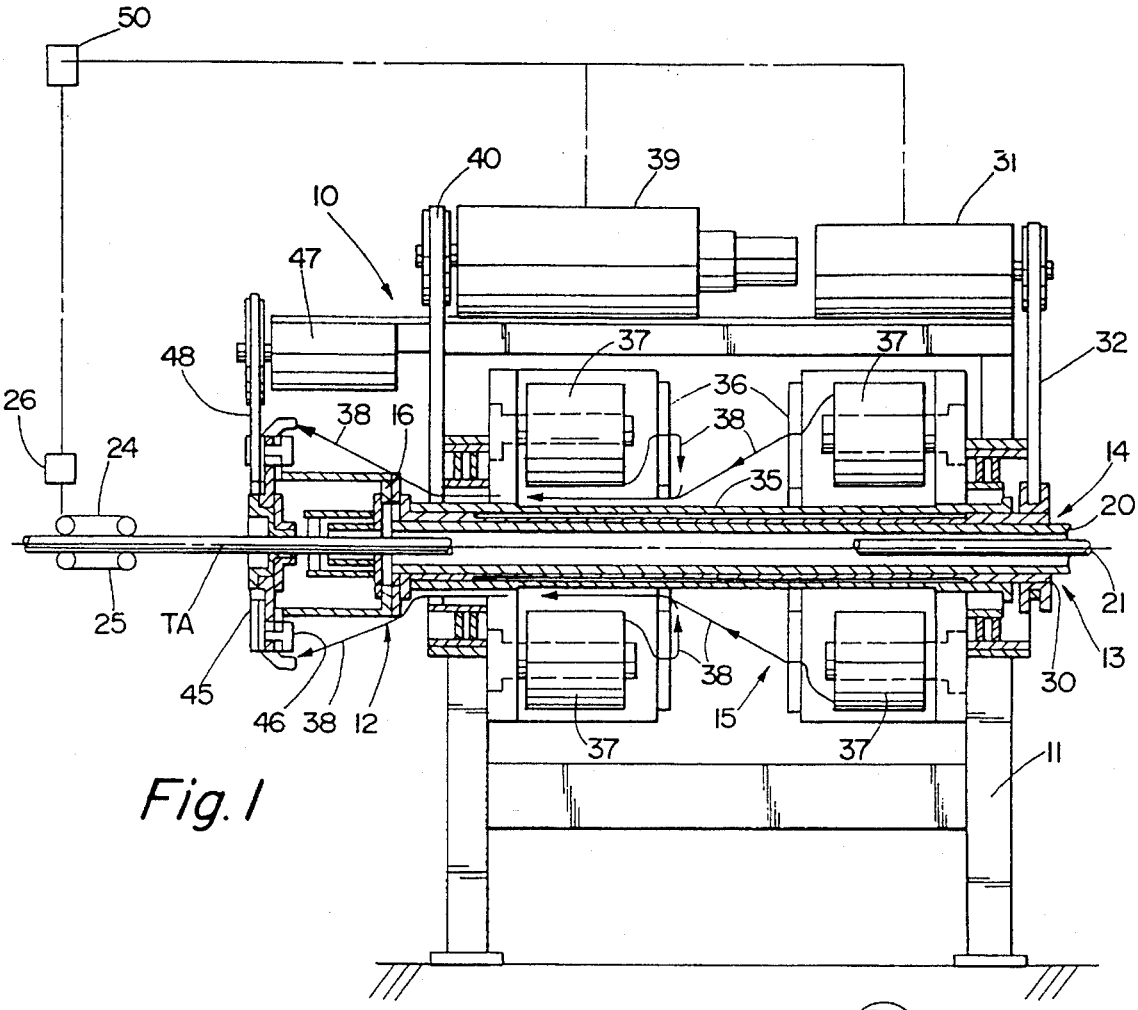
FIG. 1 is a side view of a knitting machine which is made in accordance with the invention, certain portions of the machine being shown, in section, to expose a typical inner core of a hose, as it passes through the machine.
Figure 2:
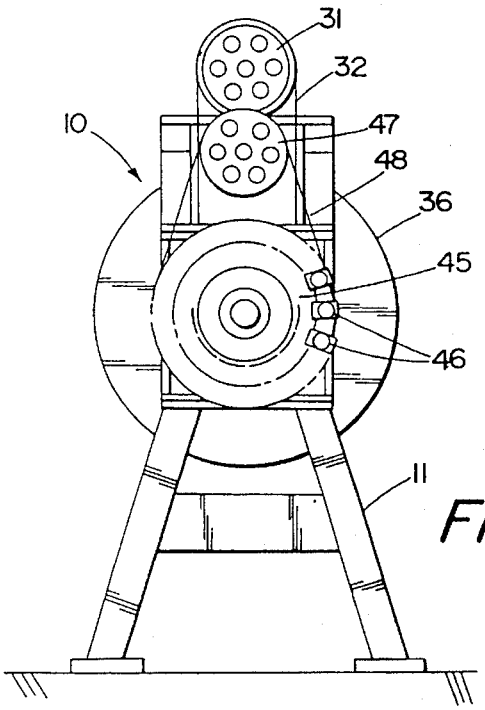
FIG. 2 is an end view of the machine.
Figure 3:
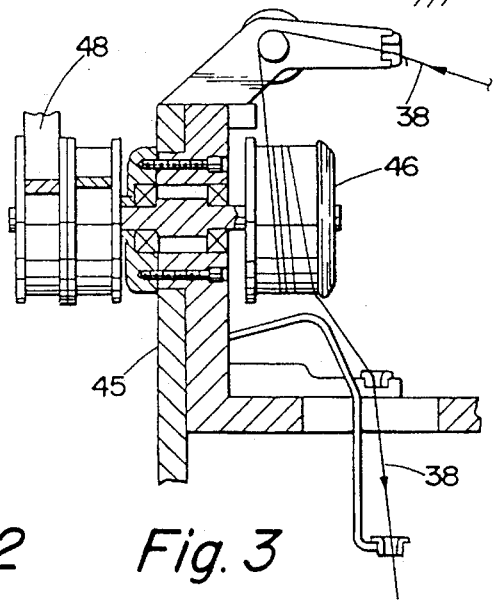
FIG. 3 is an enlarged sectional view of a portion of the machine, and shows a single capstan which is positioned between each spool of yarn and the knitting head to control the feeding of the strands of yarn to the knitting head.

With general reference to the drawing for like parts similar to those of the aforementioned '738 patent, and particular reference to FIGS. 1 and 2, there is shown a knitting machine 10 which comprises an upright standing rigid frame 11 which is designed to support at least four essential assemblies of the machine 10; namely, a knitting assembly 12, a stationary hose core guide assembly 13, a rotary needle and guide assembly 14, and a rotary yarn holding and guide assembly 15.

The knitting assembly 12 includes a knitting head 16 which has a centrally disposed opening 17 with a center axis, and a plurality of knitting needles 18 which are spaced around the opening 17 and reciprocate in associated guides 19.

The hose core guide assembly 13, in this particular case, comprises a rigid, hollow, cylindrical inner tube 20 with interior guide rollers (not shown because of size) which concentrically support an unvulcanized, hollow, cylindrical inner core 21 of a rubber hose 22 (FIG. 5) within the inner tube 20 which guides the core 21 along a straight horizontal pathway or travel axis TA which coincides with the center axis of the opening 17 of the knitting head 16 where a pattern of yarn is knitted around the outer cylindrical surface 23 of the core 21. The longitudinal axes of the inner tube 20 and core 21 within the tube 20, coincide with the travel axis TA along which the core 21 travels to the knitting head 16. It can appreciated that such an inner tube 20 may not be necessary in cases where, for example, the core 21 is made to travel in a vertical pathway to the knitting head 16.

Any suitable means, such as a pair of opposing core gripping, traction belts 24 and 25 can be used, for example, outside the machine 10 to engage and pull the core 21 along the horizontal pathway. An amply sized motor 26 can be used to drive the belts 24 and 25 to move the core 21. Auxiliary pulling or pushing means can be used at the other end of the machine 10 to help move the core 21 towards and away from the knitting head 16, if desired.

Figure 4:
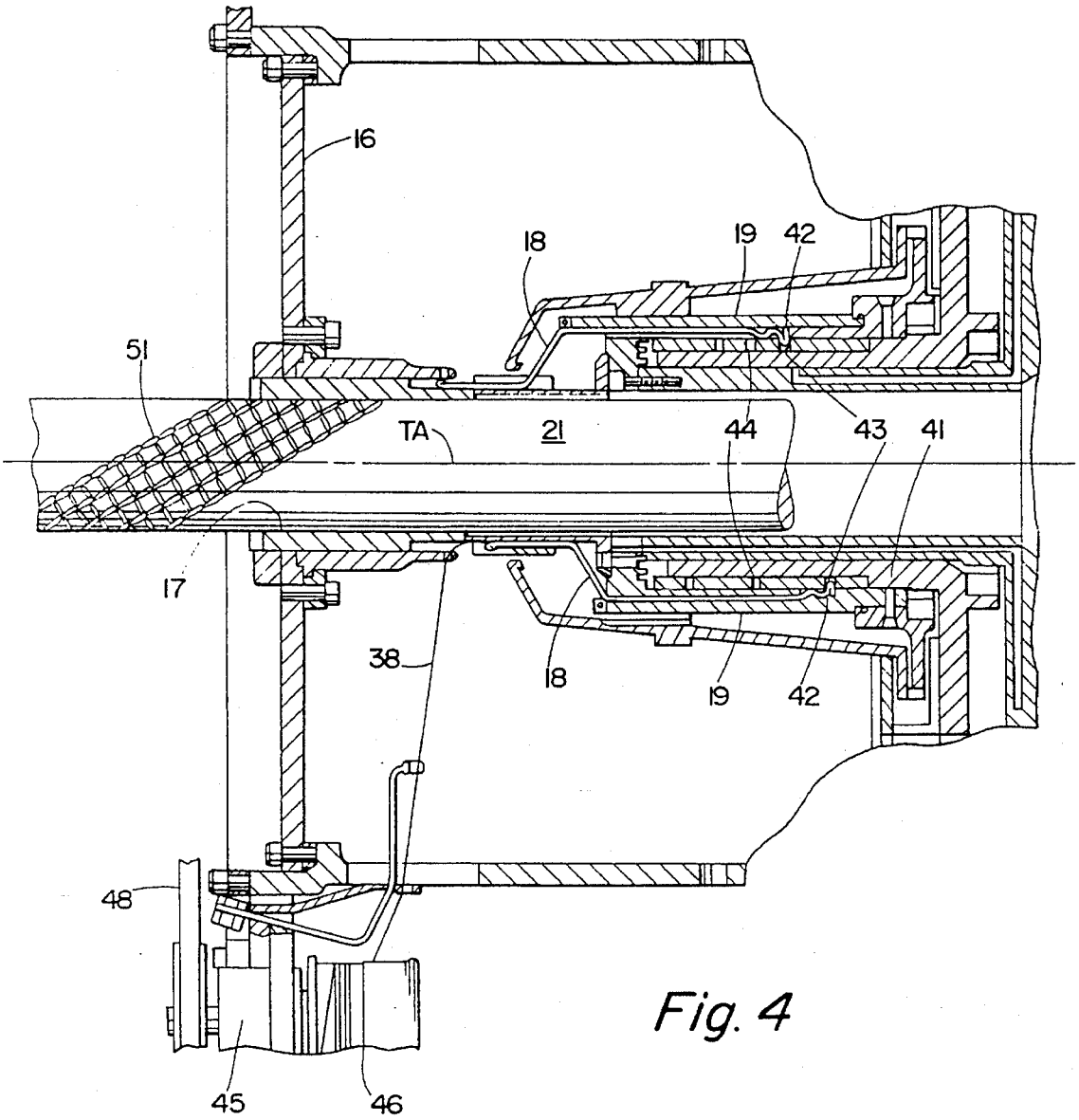
FIG. 4 is a sectional view which is designed to show a typical inner core at the knitting head.

The rotary needle and guide assembly 14 comprises a rigid, hollow, cylindrical middle tube 30 which is concentrically mounted around the stationary inner tube 20 for rotation about the travel axis TA and concentric longitudinal axes of the inner tube 20 and a core 21 traveling within the inner tube 20. As best seen in FIG. 4, the middle tube 30 carries the knitting needles 18 and guides 19 which rotate, in unison, with the middle tube 30. The knitting needles 18 are designed to reciprocate in the guides 19 longitudinally of the middle tube 30. Any suitable means, such as a motor 31 and drive belt 32, are operatively connected to the middle tube 30 to rotate the middle tube 30 and attached needles 18 and guides 19.

The rotary yarn holding and guide assembly 15 comprises a rigid, hollow, cylindrical outer tube 35 which is concentrically disposed around the other tubes 20,30, for rotation about the travel axis TA. The outer tube 35 carries one or more conventional yarn decks 36, depending on the number of yarns required to knit the particular pattern desired. Each yarn deck 36 rotates, in unison, with the outer tube 35 and carries a number of packages or spools 37 of yarn which are spaced around the longitudinal axis of the outer tube 35. The strands 38 of yarn pay out freely from the yarn packages 37 towards the knitting head 16 where they are engaged by the knitting needles 18. Any appropriate means, such as a second motor 39 and drive belt 40, are operatively connected to the outer tube 35 to rotate the outer tube 35 and attached yarn decks 36 independently of the middle tube 30. The yarn holding and guide assembly 15 also includes a caming device 41 which is mounted on the outer tube 35 for unitary rotation with the outer tube 35. The proximal ends 42 of the knitting needles 18, farthest spaced from the knitting head 16, are engaged in slots 43 that are formed between opposing cams 44 of the caming device 41, and reciprocate in their respective guides 19 in response to rotation of the caming device 41 with the outer tube 35, relative to the rotation of the middle tube 30. The knitting head 16 is also mounted on the outer tube 35 for unitary rotation with the yarn deck(s) 36 and caming device 41, and includes an optional capstan deck 45 which rotates, in unison, with the knitting head 16 and outer tube 40 and acts to guide the strands 38 of yarn from the yarn packages 37 to the knitting head 16.

The capstan deck 45 comprises a number of similar capstans 46 which are spaced around the opening 17 in the knitting head 16 and the travel axis TA. The capstans 46 are individually rotated, in unison, on the capstan deck 45 by any suitable means, e.g. a third, separate motor 47 and toothed drive belt 48 which couples the individual capstans 46 together, so that they rotate, in unison. The strands 38 of yarn from the yarn packages 37 on the yarn deck(s) 36, are reeved around the capstans 46 from where they are directed to the knitting head 16 for knitted engagement with the knitting needles 18. Reference to the above mentioned '738 patent should be made for a more detailed description of the capstan deck 45, if such is desired.

Figure 5:
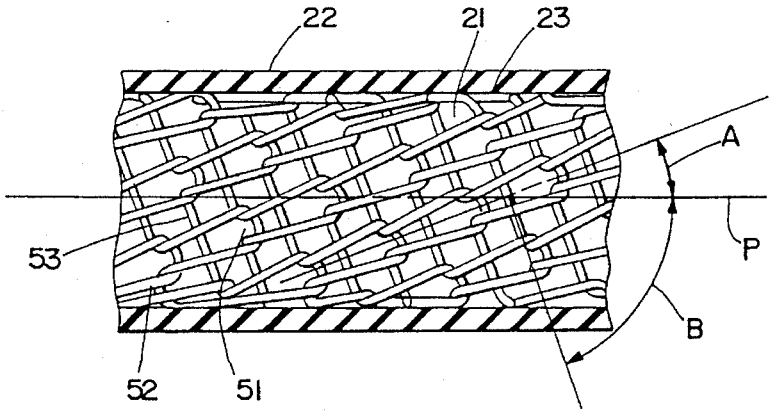
FIG. 5 is a segment of a finished hose with portions of the outer cover removed to show a portion of the helical rows of knitted loops or wales.

Any suitable means, such as a computer 50, is used to synchronize relative rotation of the middle and outer concentric tubes 30,35, and capstans 46 with movement of the inner core 21 through the opening 17 in the knitting head 16, such that the needles 18 knit rows 51 of yarn loops or wales 52 in helical relation around the core 21, the rows 51 being separated by yarn strands or courses 53. The rows 51 of yarn loops 52, as best seen in FIG. 5, are each disposed at an acute A which is in the range of from about two degrees to about fifty-five degrees, measured from a plane P containing the longitudinal axis of the core 21. Each yarn course 53 is also disposed at an acute angle B which is complementary to that of the rows 51 of yarn loops 52, that is, each set of angles A and B acid up to about ninety degrees.

Another method of knitting rows of knitted loops of yarn in helical relation around a an inner hose core would be to rotate the inner core while applying the knitted pattern of yarn. It can be appreciated by those skilled in the art, that this would be highly impractical and require far more elaborate and complex machinery than that described above.

Thus, there has been described a unique knitting machine that has a rotary needle and guide assembly for knitting around the inner core of a hose, an unusual pattern of knitted yarn loops or wales in helical relation around the inner core.

What is claimed is:

1. A knitting machine for knitting a pattern of yarn in helical relation around the hollow, cylindrical inner core of a hose, comprising:

a) a knitting head having a centrally disposed opening with a center axis;

b) means for guiding a hollow, cylindrical, inner core to the opening in the knitting head along a straight axis which coincides with the center axis of the opening in the knitting head;

c) a first, rigid, hollow, cylindrical tube concentrically disposed around the straight axis along which the inner core moves to the opening in the knitting head, the first tube being rotatable about the straight axis and carrying a plurality of knitting needles and guides which are rotatable with the first tube, the needles and guides being spaced around the opening in the knitting head, and the plurality of needles being designed to reciprocate longitudinally of the first tube;

d) a second, rigid, hollow, cylindrical tube concentrically disposed around the first tube and rotatable around the straight axis, the second tube carrying at least one yarn deck which is rotatable with the second tube, the yarn deck including a plurality of packages of yarn from which strands of yarn pay out towards the knitting head;

e) means for rotating the first and second tubes independently of each other;

f) means carried by the second tube and rotatable therewith, for reciprocating the needles in the guides in response to rotation of the second tube relative to the first tube; and g) means mounting the knitting head for unitary rotation with the second tube.

2. The knitting machine of claim 1, wherein the means for rotating the first and second tubes, includes means for differentially rotating the first and second tubes, relative to movement of the inner core through the opening in the knitting head, such that the knitting needles knit a knitted pattern of yarn in helical relation around the inner core.

3. The knitting machine of claim 2, wherein the means mounting the knitting head for unitary rotation with the second tube, includes mounting the knitting head on the second tube.

4. The knitting machine of claim 3, wherein the means for reciprocating the needles in the guides, includes a caming device having a plurality of cams which are carried by the second tube and spaced around the straight axis for engaging and reciprocating the knitting needles, as the cams rotate, in unison, with the second tube around the straight axis.

5. The knitting machine of claim 4, wherein the plurality of cams are oppositely disposed and form between them, a continuous slot, which extends around the first tube and is designed to receive the proximal ends of the needles farthest spaced from the knitting head, the cams being mounted on the second tube adjacent the proximal ends of the needles.

6. The knitting machine of claim 5, wherein the straight axis, along which the inner core moves to the opening in the knitting head, is horizontally disposed.

7. The knitting machine of claim 6, which includes a third, rigid, hollow cylindrical tube which is stationary and concentrically disposed within the first tube, the third tube having a longitudinal axis which coincides with the straight axis and along which the inner core moves within the third tube towards the opening in the knitting head.

8. The knitting machine of claim 7, which includes:

h) a capstan deck integral with the knitting head and rotatable therewith, the capstan deck being spaced downstream from the knitting head relative to movement of the inner core past the knitting head, the capstan deck having a plurality of rotary capstans which are spaced around the opening in the knitting head; and j) means for rotating the capstans, in unison, as the capstan deck rotates with the second tube.

9. The knitting machine of claim 8, which includes means for synchronizing rotation of the first tube relative to, i) the rotation of the second tube, ii) the rotation of the capstans, and iii) movement of the inner core through the opening in the knitting head, such that rows of knitted loops are knitted in helical relation around the inner core.

10. A method of knitting a pattern of yarn around the outer cylindrical surface of a cylindrical, hollow core which is composed of a polymeric or elastomeric material such as rubber, comprising the steps of:

a) moving such a cylindrical, hollow core along a straight pathway leading to an opening in a knitting head; and b) knitting rows of yarn loops in helical relation around the hollow core as it moves through the opening.

11. The method of claim 10, wherein the rows of loops are at acute angles of from about two degrees to about fifty-five degrees measured from a plane containing the longitudinal axis of the core.

12. The method of claim 11, wherein the rows of loops are separated by courses of yarn which are also disposed at similarly measured acute angles, the acute angles of each row and course, when added together, equal about ninety degrees.

13. The method of claim 12, wherein the step of knitting the rows of yarn loops in helical relation around the core is accomplished by:

c) moving the core at a predetermined speed along a straight axis which is axially aligned with the center axis of the opening in the knitting head;

d) rotating a separate, first tube concentrically around the straight axis in synchronized relation with the speed at which the core moves through the opening in the knitting head, the first tube carrying a plurality of reciprocating knitting needles which are spaced around the opening in the knitting head; and e) rotating a separate, second tube concentrically around the first tube and straight axis in synchronized relation with the rotation of the first tube, the second tube carrying the knitting head, means for reciprocating the knitting needles, and at least one yarn deck which has a plurality of packages of yarn.

14. The method of claim 13, wherein the inner core moves through a stationary, rigid, hollow, cylindrical third tube which has a horizontally disposed longitudinal axis which coincides with the straight axis along which the inner core moves.

15. The method of claim 14, wherein strands of yarn are sent from the yarn packages to the rotating knitting head via a plurality of individual capstans which are spaced around the opening in the knitting head, the capstans rotating, in unison, as they rotate as a body, in unison, with the knitting head.

16. A yarn reinforced hose made in accordance with the method of claim 10.

* * * * *